US011062843B2

(12) United States Patent
Kuniyoshi

(10) Patent No.: US 11,062,843 B2
(45) Date of Patent: *Jul. 13, 2021

(54) METHOD FOR PRODUCING SINTERED R-T-B BASED MAGNET AND DIFFUSION SOURCE

(71) Applicant: HITACHI METALS, LTD., Tokyo (JP)

(72) Inventor: Futoshi Kuniyoshi, Minato-ku (JP)

(73) Assignee: HITACHI METALS, LTD., Tokyo (JP)

( * ) Notice: Subject to any disclaimer, the term of this patent is extended or adjusted under 35 U.S.C. 154(b) by 397 days.

This patent is subject to a terminal disclaimer.

(21) Appl. No.: 16/143,569

(22) Filed: Sep. 27, 2018

(65) Prior Publication Data

US 2019/0096575 A1 Mar. 28, 2019

(30) Foreign Application Priority Data

Sep. 28, 2017 (JP) ..... JP2017-187701
Sep. 28, 2017 (JP) ..... JP2017-187707

(51) Int. Cl.

| | |
|---|---|
| ***H01F 41/02*** | (2006.01) |
| ***C22C 28/00*** | (2006.01) |
| ***H01F 1/055*** | (2006.01) |
| ***H01F 1/057*** | (2006.01) |

(52) U.S. Cl.

CPC ..... *H01F 41/0293* (2013.01); *C22C 28/00* (2013.01); *H01F 1/0557* (2013.01); *H01F 1/0577* (2013.01)

(58) Field of Classification Search

CPC ..... C22C 28/00; H01F 1/0557; H01F 1/0577; H01F 41/0293

USPC ..... 148/302

See application file for complete search history.

(56) References Cited

U.S. PATENT DOCUMENTS

| | | | | |
|---|---|---|---|---|
| 9,044,810 | B2 * | 6/2015 | Nomura | H01F 41/0293 |
| 2011/0000586 | A1 | 1/2011 | Nomura et al. | |
| 2012/0286191 | A1 * | 11/2012 | Maeda | C22C 38/005 252/62.54 |

(Continued)

FOREIGN PATENT DOCUMENTS

| | | | |
|---|---|---|---|
| CN | 101572145 | A | 11/2009 |
| CN | 107077965 | A | 8/2017 |
| JP | 2011-014668 | A | 1/2011 |

OTHER PUBLICATIONS

Official Communication issued in corresponding Chinese Patent Application No. 201811140200.1, dated Feb. 5, 2021.

*Primary Examiner* — Jie Yang

(74) *Attorney, Agent, or Firm* — Keating & Bennett, LLP

(57) ABSTRACT

A method for producing a sintered R-T-B based magnet includes the steps of: providing a sintered R1-T-B based magnet work (where R1 is a rare-earth element; T is Fe, or Fe and Co); providing a powder of an alloy in which a rare-earth element R2 accounts for 40 mass % or more of the entire alloy, the rare-earth element R2 always including Dy and/or Tb; subjecting the powder to a heat treatment to obtain a diffusion source; and heating the sintered R1-T-B based magnet work with the diffusion source to allow the at least one of Dy and Tb contained in the diffusion source to diffuse from the surface into the interior of the sintered R1-T-B based magnet work. The alloy powder is a powder produced by atomization.

4 Claims, 1 Drawing Sheet

(56) References Cited

U.S. PATENT DOCUMENTS

| | | | | |
|---|---|---|---|---|
| 2018/0240590 | A1 | 8/2018 | Kuniyoshi | |
| 2019/0096550 | A1* | 3/2019 | Kuniyoshi | ..... C22C 1/0491 |

* cited by examiner

METHOD FOR PRODUCING SINTERED R-T-B BASED MAGNET AND DIFFUSION SOURCE

BACKGROUND

1. Technical Field

The present disclosure relates to a method for producing a sintered R-T-B based magnet (where R is a rare-earth element; and T is Fe, or Fe and Co) and a diffusion source to be used for the production of a sintered R-T-B based magnet (where R is a rare-earth element; and T is Fe, or Fe and Co).

2. Description of the Related Art

Sintered R-T-B based magnets whose main phase is an $R_2T_{14}B$-type compound are known as permanent magnets with the highest performance, and are used in voice coil motors (VCMs) of hard disk drives, various types of motors such as motors to be mounted in hybrid vehicles, home appliance products, and the like.

Intrinsic coercivity $H_{cJ}$ (hereinafter simply referred to as "$H_{cJ}$") of sintered R-T-B based magnets decreases at high temperatures, thus causing an irreversible thermal demagnetization. In order to avoid irreversible thermal demagnetization, when used in a motor or the like, they are required to maintain high $H_{cJ}$ even at high temperatures.

It is known that if R in the $R_2T_{14}B$-type compound phase is partially replaced with a heavy rare-earth element RH (Dy, Tb), $H_{cJ}$ of a sintered R-T-B based magnet will increase. In order to achieve high $H_{cJ}$ at high temperature, it is effective to profusely add a heavy rare-earth element RH in the sintered R-T-B based magnet. However, if a light rare-earth element RL (Nd, Pr) that is an R in a sintered R-T-B based magnet is replaced with a heavy rare-earth element RH, $H_{cJ}$ will increase but there is a problem of decreasing remanence $B_r$ (hereinafter simply referred to as "$B_r$"). Furthermore, since heavy rare-earth elements RH are rare natural resources, their use should be cut down.

Accordingly, in recent years, it has been attempted to improve $H_{cJ}$ of a sintered R-T-B based magnet with less of a heavy rare-earth element RH, this being in order not to lower $B_r$. For example, it has been proposed to introduce on the surface of a sintered magnet a fluoride or oxide of a heavy rare-earth element RH or any of a variety of metals M or M alloys, either by itself alone or in mixture, and subject it to a heat treatment in order to allow the heavy rare-earth element RH contributing to improved coercivity to be diffused into the magnet.

Japanese Laid-Open Patent Publication No. 2011-14668 (hereinafter "Patent Document 1" discloses a method for producing a rare-earth magnet, which includes the steps of: introducing a powder of an alloy containing $R^2$ and M onto the surface of an $R^1$-T-B based sintered compact whose main phase is an $R^1{}_2T_{14}B$-type compound; and allowing the $R^2$ element to diffuse from the alloy powder into the sintered compact through a heat treatment. Herein, R1 is one element, or two or more elements, selected from among rare-earth elements containing Sc and Y; and T is Fe and/or Co. On the other hand, $R^2$ is one element, or two or more elements, selected from among rare-earth elements containing Sc and Y; and M is a metallic element such as B, C, Al, Si, or Ti.

In the production method disclosed in Patent Document 1, a quenched alloy powder is used as the powder of an alloy containing $R^2$ and M. This quenched alloy powder contains a microcrystalline alloy having an average crystal grain size of 3 μm or less or an amorphous alloy.

SUMMARY

The present disclosure realizes, in a method which uses a diffusion source containing at least one of Dy and Tb, allowing the at least one of Dy and Tb to be diffused more uniformly.

In an illustrative embodiment, a method for producing a sintered R-T-B based magnet according to the present disclosure comprises: a step of providing a sintered R1-T-B based magnet work (where R1 is a rare-earth element; T is Fe, or Fe and Co); a step of providing a powder of an alloy in which a rare-earth element R2 accounts for 40 mass % or more of the entire alloy, the rare-earth element R2 always including at least one of Dy and Tb; a step of subjecting the alloy powder to a heat treatment at a temperature which is not lower than a temperature that is 250° C. below a melting point of the alloy powder and which is not higher than the melting point, to obtain a diffusion source from the alloy powder; and a diffusing step of placing the sintered R1-T-B based magnet work and the diffusion source in a process chamber, and heating the sintered R1-T-B based magnet work and the diffusion source to a temperature which is not higher than a sintering temperature of the sintered R1-T-B based magnet work, to allow the at least one of Dy and Tb contained in the diffusion source to diffuse from the surface into an interior of the sintered R1-T-B based magnet work, wherein the alloy powder is a powder produced by atomization.

In one embodiment, an oxygen content in the diffusion source is not less than 0.5 mass % and not more than 4.0 mass %.

In one embodiment, the alloy is an RHRLM1M2 alloy (where RH is one or more selected from the group consisting of Sc, Y, Gd, Tb, Dy, Ho, Er, Tm, Yb and Lu, always including at least one of Tb and Dy; RL is one selected from the group consisting of La, Ce, Pr, Nd, Pm, Sm and Eu, always including at least one of Pr and Nd; and each of M1 and M2 is one or more selected from the group consisting of Cu, Fe, Ga, Co, Ni and Al, where possibly M1=M2).

In one embodiment, the alloy is an RHM1M2 alloy (where RH is one or more selected from the group consisting of Sc, Y, Gd, Tb, Dy, Ho, Er, Tm, Yb and Lu, always including at least one of Tb and Dy; and each of M1 and M2 is one or more selected from the group consisting of Cu, Fe, Ga, Co, Ni and Al, where possibly M1=M2).

In an illustrative embodiment, a diffusion source according to the present disclosure is a powder of an alloy in which a rare-earth element R2 accounts for 40 mass % or more of the entire alloy, the rare-earth element R2 always including at least one of Dy and Tb, wherein, the alloy powder is composed of particles of an intermetallic compound having an average crystal grain size exceeding 3 μm; and the particles have a circular cross section.

In one embodiment, the oxygen content in the diffusion source is not less than 0.5 mass % and not more than 4.0 mass %.

In one embodiment, the alloy powder is a powder of an RHRLM1M2 alloy (where RH is one or more selected from the group consisting of Sc, Y, Gd, Tb, Dy, Ho, Er, Tm, Yb and Lu, always including at least one of Tb and Dy; RL is one selected from the group consisting of La, Ce, Pr, Nd, Pm, Sm and Eu, always including at least one of Pr and Nd;

and each of M1 and M2 is one or more selected from the group consisting of Cu, Fe, Ga, Co, Ni and Al, where possibly M1=M2).

In one embodiment, the alloy powder is a powder of an RHM1M2 alloy (where RH is one or more selected from the group consisting of Sc, Y, Gd, Tb, Dy, Ho, Er, Tm, Yb and Lu, always including at least one of Tb and Dy; and each of M1 and M2 is one or more selected from the group consisting of Cu, Fe, Ga, Co, Ni and Al, where possibly M1=M2).

According to an embodiment of the present disclosure, a diffusion source containing at least one of Dy and Tb is modified in texture, thereby making it possible to improve $H_{cJ}$ of a sintered R-T-B based magnet while suppressing variations in its magnetic characteristics.

DETAILED DESCRIPTION

Figure 1A:
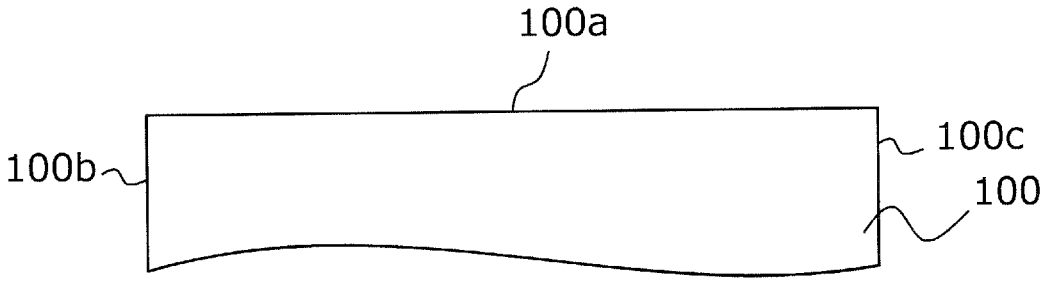
FIG. 1A is a cross-sectional view schematically showing a portion of a sintered R1-T-B based magnet work provided in an embodiment of the present disclosure.

In the present specification, a rare-earth element is at least one element selected from the group consisting of scandium (Sc), yttrium (Y), and lanthanoid. Herein, lanthanoids collectively refer to the 15 elements from lanthanum to lutetium. R is a rare-earth element.

In an illustrative embodiment, a method for producing a sintered R-T-B based magnet according to the present disclosure includes:

1. a step of providing a sintered R1-T-B based magnet work (where R1 is a rare-earth element; T is Fe, or Fe and Co);

2. a step of providing a powder of an alloy in which a rare-earth element R2 accounts for 40 mass % or more of the entire alloy, the rare-earth element R2 always including at least one of Dy and Tb;

3. a step of subjecting the alloy powder to a heat treatment at a temperature which is not lower than a temperature that is 250° C. below a melting point of the alloy powder and which is not higher than the melting point, to obtain a diffusion source from the alloy powder; and 4. a diffusing step of placing the sintered R1-T-B based magnet work and the diffusion source in a process chamber, and heating the sintered R1-T-B based magnet work and the diffusion source to a temperature which is not higher than a sintering temperature of the sintered R1-T-B based magnet work, to allow the at least one of Dy and Tb contained in the diffusion source to diffuse from the surface of the sintered R1-T-B based magnet work into the interior.

In an illustrative embodiment, a diffusion source according to the present disclosure may be as follows.

(1) It is a powder of an alloy in which a rare-earth element R2 accounts for 40 mass % or more of the entire alloy, the rare-earth element R2 always including at least one of Dy and Tb.

(2) The alloy powder is composed of particles of an intermetallic compound having an average crystal grain size exceeding 3 μm.

(3) The particles have a circular cross section.

Since the diffusion source is composed of particles of an intermetallic compound having an average crystal grain size exceeding 3 μm, it becomes possible to improve $H_{cJ}$ of the sintered R-T-B based magnet while suppressing variations in the characteristics.

In the present disclosure, the diffusion source is a powder which is produced by atomization. As a result, particles of the powder composing the diffusion source have a circular cross section.

Hereinafter, embodiments of the present disclosure will be described. Note however that unnecessarily detailed descriptions may be omitted. For example, detailed descriptions on what is well known in the art or redundant descriptions on what is substantially the same constitution may be omitted. This is to avoid lengthy description, and facilitate the understanding of those skilled in the art. The accompanying drawings and the following description, which are provided by the inventors so that those skilled in the art can sufficiently understand the present disclosure, are not intended to limit the scope of claims.

1. A Step of Providing a Sintered R1-T-B Based Magnet Work

An sintered R1-T-B based magnet work (where R1 is a rare-earth element; T is Fe, or Fe and Co), to which at least one of Dy and Tb is to be diffused, is provided. As the sintered R1-T-B based magnet work, any known magnet work may be used.

The sintered R1-T-B based magnet work may have the following composition, for example.

rare-earth element R1: 12 to 17 at %

B (B (boron), part of which may be replaced with C (carbon)): 5 to 8 at % additive element(s) M (at least one selected from the group consisting of Al, Ti, V, Cr, Mn, Ni, Cu, Zn, Ga, Zr, Nb, Mo, Ag, In, Sn, Hf, Ta, W, Pb and Bi): 0 to 5 at %

T (transition metal element, which is mainly Fe and may include Co) and inevitable impurities: balance Herein, the rare-earth element R1 is essentially Nd or Pr, but may include at least one of Dy and Tb.

The sintered R1-T-B based magnet work of the above composition may be produced by any known production method. The sintered R1-T-B based magnet work may just have been sintered, or may have been subjected to cutting or polishing. The sintered R1-T-B based magnet work may be of any shape and size.

2. A Step of Providing Alloy Powder

[Alloy]

The alloy is an alloy in which a rare-earth element R2 accounts for 40 mass % or more of the entire alloy, where the rare-earth element R2 always includes at least one of Dy and Tb. An example of an alloy in which a rare-earth element R2 accounts for 40 mass % or more of the entire alloy, where the rare-earth element R2 always includes at least one of Dy and Tb, may be one in which the rare-earth element R2 consists only of at least one of Dy and Tb, or one in which the rare-earth element R2 comprises at least one of Dy and Tb and at least one of Pr and Nd. In either case, it suffices if the rare-earth element R2 accounts for 40 mass % or more of the entire alloy. If the rare-earth element R2 accounts for less than 40 mass % of the entire alloy, high $H_{cJ}$ may not be obtained. Typical examples of the alloy may be RHM1M2 alloys and RHRLM1M2 alloys. Hereinafter, examples of these alloys will be described.

(RHM1M2 Alloy)

One example of the alloy is an RHM1M2 alloy (where RH is one or more selected from the group consisting of Sc, Y, Gd, Tb, Dy, Ho, Er, Tm, Yb and Lu, always including at least one of Tb and Dy; and each of M1 and M2 is one or more selected from the group consisting of Cu, Fe, Ga, Co, Ni and Al, where possibly M1=M2), for example.

Typical examples of RHM1M2 alloys are a DyFe alloy, a DyAl alloy, a DyCu alloy, a TbFe alloy, a TbAl alloy, a TbCu alloy, a DyFeCu alloy, a TbCuAl alloy, and the like.

(RHRLM1M2 Alloy)

Another example of the alloy is an RHRLM1M2 alloy (where RH is one or more selected from the group consisting of Sc, Y, Gd, Tb, Dy, Ho, Er, Tm, Yb and Lu, always including at least one of Tb and Dy; RL is one selected from the group consisting of La, Ce, Pr, Nd, Pm, Sm and Eu, always including at least one of Pr and Nd; and each of M1 and M2 is one or more selected from the group consisting of Cu, Fe, Ga, Co, Ni and Al, where possibly M1=M2). Typical examples of RHRLM1M2 alloys are a TbNdCu alloy, a DyNdCu alloy, a TbNdFe alloy, a DyNdFe alloy, a TbNdCuAl alloy, a DyNdCuAl alloy, a TbNdCuCo alloy, a DyNdCuCo alloy, a TbNdCoGa alloy, a DyNdCoGa alloy, a TbNdPrCu alloy, a DyNdPrCu alloy, a TbNdPrFe alloy, a DyNdPrFe alloy, and the like. Note that the alloy is not limited to the aforementioned RHM1M2 alloys and RHRLM1M2 alloys. So long as the alloy always includes at least one of Dy and Tb, where the rare-earth element R2 accounts for 40 mass % or more of the entire alloy, any other element and impurity may be contained.

[Alloy Powder]

In the present disclosure, the alloy powder is a powder which is produced by atomization. A powder which is produced by atomization may be referred to as an "atomized powder".

Atomization is a kind of powder producing method, also called molten spraying, and may include any known atomization method such as gas atomization and plasma atomization. For example, in gas atomization, a metal or an alloy is melted in a furnace to form a melt thereof, this melt being sprayed into an inert gas ambient such as nitrogen, argon, etc., and solidified. Since the sprayed melt will scatter in the form of minute droplets, they become rapidly cooled and solidify. Since each resultant powder particle has a spherical shape, they do not need to be mechanically pulverized later. The powder particles that are produced through atomization may range from 10 μm to 200 μm, for example.

In atomization, the droplets of the sprayed alloy melt are small, and each droplet has a relatively large surface area for its mass, and thus the cooling rate is high. As a result of this, the resultant powder particles are amorphous or microcrystalline. However, in the present disclosure, these powder particles are subjected to a heat treatment as will be described later, whereby the amorphous portion become crystallized, and microcrystalline portion become larger, until they finally attain a textural structure that is suitable for being a diffusion source.

When an alloy melt is rapidly cooled and solidified through atomization, it is difficult to strictly control its cooling rate. Therefore, its textural structure may fluctuate from powder particle to particle. For example, the minute crystal grains to be generated in each powder particle may have a considerably varying size, from particle to particle. Specifically, particles having an average crystal grain size of 1 μm and particles having an average crystal grain size of 3 μm may both be created, for example. Under such fluctuations in terms of textural structure and average crystal grain size, in the diffusing step to be described later, fluctuations will occur in the melting temperature of the phase that composes the particles and in the rate with which Dy and/or Tb may be supplied as a diffusion source. Such fluctuations will eventually induce variations in the magnet characteristics.

In order to solve this problem, in an embodiment of the present disclosure, the alloy powder (diffusion source) is composed of particles of an intermetallic compound whose average crystal grain size exceeds 3 μm. As a result of this, crystallinity of the powder particles composing the alloy powder is modified, whereby a diffusion source with good uniformity can be obtained. Using this diffusion source allows to suppress variations in the magnetic characteristics in the diffusing step. Herein, an intermetallic compound phase refers to the entirety of the crystal grains of the intermetallic compound within each powder particle composing the diffusion source. When there is more than one kind of intermetallic compound within each powder particle composing the diffusion source, the intermetallic compound phase refers to the entirety of the crystal grain(s) of the intermetallic compound that is contained in the largest amount. It is not necessary for all of the alloy powder composing the diffusion source to be composed of particles of an intermetallic compound whose average crystal grain size exceeds 3 μm. The effects according to the embodiments of the present invention can be obtained so long as 80 vol % or more of the diffusion source (i.e., the entire alloy powder) is composed of particles of an intermetallic compound whose average crystal grain size exceeds 3 μm.

In order to achieve this constitution, the diffusion source is obtained by performing a heat treatment as described below, for example.

3. A Step of Obtaining Diffusion Source from Alloy Powder

[Heat Treatment for Alloy Powder]

In an embodiment of the present disclosure, the alloy powder is subjected to a heat treatment at a temperature which is not lower than a temperature that is 250° C. below a melting point of the alloy powder and which is not higher than the melting point.

As a result, crystallinity of the powder particles composing the alloy powder is modified, whereby a diffusion source with good uniformity can be obtained from the alloy powder. Using this diffusion source allows to suppress variations in the magnetic characteristics in the diffusing step. For example, the time of heat treatment may be not less than 30 minutes and not more than 10 hours. In such a diffusion source, the intermetallic compound phase will have an average crystal grain size exceeding 3 μm. Preferably, the average crystal grain size of the intermetallic compound phase in the diffusion source is not less than 3.5 μm and not more than 20 μm. Herein, an intermetallic compound phase refers to the entirety of the crystal grains of the intermetallic compound within each powder particle composing the diffusion source. When there is more than one kind of intermetallic compound within each powder particle composing the diffusion source, the intermetallic compound phase refers to the entirety of the crystal grain(s) of the intermetallic compound that is contained in the largest amount.

If the temperature of the heat treatment for the alloy powder is less than a temperature that is 250° C. below the melting point of the alloy powder, the intermetallic compound of the powder particles composing the alloy powder will have an average crystal grain size of 3 μm or less due to excessively low temperature, so that crystallinity may possibly not be modified. Therefore, above the melting point, powder particles may melt and adhere to each other, only to hinder an efficient diffusion treatment. Preferably, the powder particles composing the diffusion source have an average particle size of not less than 3.5 μm and not more than 20 μm.

In this heat treatment, by adjusting the ambient within the furnace, it is preferably ensured that the oxygen content in the diffusion source after the heat treatment is not less than 0.5 mass % and not more than 4.0 mass %. By intentionally oxidizing the entire surface of the alloy particles composing the atomized powder, it is possible to reduce characteristic variations from particle to particle that may occur because of the contacting time between the powder particles and the atmospheric air, a difference in humidity therebetween, etc., whereby variations in the magnetic characteristics in the diffusing step can be further reduced. Moreover, the powder particles are less likely to ignite through contact with the oxygen in the atmospheric air. This will facilitate quality control of the diffusion source.

In an embodiment, the diffusion source is in powder state. The particle size of a diffusion source in powder state can be adjusted through screening. If the powder to be eliminated through screening accounts for less than 10 mass %, it will not matter very much; thus, the entire powder may be used without screening.

A diffusion source in powder state may be granulated together with a binder, as necessary.

[Diffusion Auxiliary Agent]

The diffusion source which is produced by subjecting the alloy powder to the aforementioned heat treatment may further contain an alloy powder that functions as a diffusion auxiliary agent. An example of such an alloy is an RLM1M2 alloy. RL is one or more selected from the group consisting of La, Ce, Pr, Nd, Pm, Sm and Eu, always including at least one of Pr and Nd; and each of M1, M2 is one or more selected from the group consisting of Cu, Fe, Ga, Co, Ni and Al, where possibly M1=M2. Typical examples of RLM1M2 alloys are an NdCu alloy, an NdFe alloy, an NdCuAl alloy, an NdCuCo alloy, an NdCoGa alloy, an NdPrCu alloy, an NdPrFe alloy, and the like. Any such alloy powder may be used in a mixture with the aforementioned alloy powder. Different kinds of RLM1M2 alloy powders may be mixed within the alloy powder.

There is no limitation as to the method of producing the RLM1M2 alloy powder. In the case of producing it through rapid cooling or casting, for better pulverizability, it is preferable to ensure that M1≠M2 and to use an alloy which is ternary or above, e.g., an NdCuAl alloy, an NdCuCo alloy, or an NdCoGa alloy, for example. The particle size of the RLM1M2 alloy powder is e.g. 200 μm or less, and the smaller ones may be on the order of 10 μm.

Thus, a diffusion source according to an embodiment of the present disclosure may contain as an essential constituent element an alloy powder which has been subjected to a heat treatment, and also contain a powder which is made from another material.

In the case where a diffusion source is used in a mixture with an RLM1M2 alloy powder, merely trying to mix these powders may not allow them to become uniformly mixed. The reason is that, generally speaking, an atomized powder has a smaller particle size than does an RLM1M2 alloy powder. Therefore, it is preferable to granulate the RLM1M2 alloy powder and the atomized powder with a binder. Using such granulated matter provides an advantage in that the mixing ratio between the RLM1M2 alloy powder and the alloy powder can be made uniform over the entire powder. Such granulated matter also allows itself to be uniformly present across a magnet surface.

As the binder, those which will not adhere or agglomerate upon drying or upon removal of a solvent mixed therein, and which will allow smooth fluidity of the powder particles composing the diffusion source, are preferable. Examples of binders include PVA (polyvinyl alcohol) and the like. As necessary, an aqueous solvent such as water or an organic solvent such as NMP (n-methylpyrrolidone) may be used for mixing. The solvent is to be evaporated away in the process of granulation to be described later.

The method of granulation with a binder may be arbitrary, e.g., a tumbling granulation method, a fluidized layer granulation method, a vibration granulation method, a high-speed impact method (hybridization), a method of mixing the powder with a binder and disintegrating it after solidification, and so on.

In an embodiment of the present disclosure, presence of another powder (a third powder) in addition to the aforementioned powder, as there may be on the surface of the sintered R1-T-B based magnet work, is not always precluded; however, it must be ensured that any third powder will not hinder at least one of Dy and Tb in the diffusion source from diffusing into the sintered R1-T-B based magnet work. It is desirable that "an alloy containing at least one of Dy and Tb" accounts for a mass ratio of 70% or more with respect to the entire powder that is present on the surface of the sintered R1-T-B based magnet work.

4. A Step of Diffusing at Least One of Dy and Tb

In order to heat the sintered R1-T-B based magnet work and the diffusion source to a temperature which is not higher than a sintering temperature of the sintered R1-T-B based magnet work, first, the sintered R1-T-B based magnet work and the diffusion source are placed in a process chamber. At this time, the sintered R1-T-B based magnet work and the diffusion source are preferably in contact with each other in the process chamber.

[Placement]

The manner of placing the sintered R1-T-B based magnet work and the diffusion source in contact with each other may be arbitrary, including e.g. a method in which, by using fluidized-bed coating method, allowing a diffusion source in powder state to adhere to a sintered R1-T-B based magnet work on which a tackiness agent has been applied; a method of dipping the sintered R1-T-B based magnet work into a process chamber that accommodates a diffusion source in powder state; a method of sprinkling a diffusion source in powder state over the sintered R1-T-B based magnet work; and so on. Moreover, a process chamber that accommodates a diffusion source may be allowed to undergo vibration, swing, or rotation, or a diffusion source in powder state may be allowed to flow in a process chamber.

FIG. 1A is a cross-sectional view schematically showing a portion of a sintered R1-T-B based magnet work 100 to be used in a method for producing a sintered R-T-B based magnet according to the present disclosure. The FIGURE shows an upper face 100*a* and side faces 100*b* and 100*c* of the sintered R1-T-B based magnet work 100. The shape and size of a sintered R1-T-B based magnet work to be used for the production method according to the present disclosure are not limited to the shape and size of the sintered R1-T-B based magnet work 100 as shown in the FIGURE. Although the upper face 100*a* and the side faces 100*b* and 100*c* of the sintered R1-T-B based magnet work 100 shown in the FIGURE are flat, the surface of the sintered R1-T-B based magnet work 100 may have rises and falls or a stepped portion(s), or be curved.

Figure 1B:
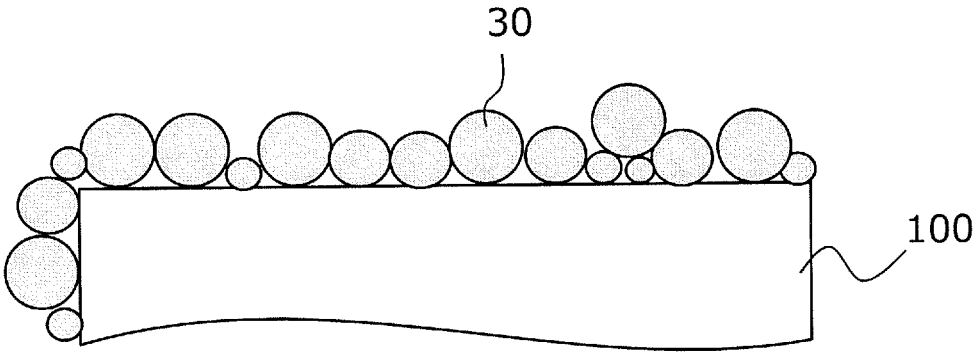
FIG. 1B is a cross-sectional view schematically showing, in an embodiment of the present disclosure, a portion of a sintered R1-T-B based magnet work being in contact with a diffusion source.

FIG. 1B is a cross-sectional view schematically showing a portion of the sintered R1-T-B based magnet work 100 in a state where powder particles composing a diffusion source 30 are present on the surface. The powder particles 30 composing the diffusion source that is on the surface of the sintered R1-T-B based magnet work 100 may adhere to the surface of the sintered R1-T-B based magnet work 100 via an adhesion layer not shown. Such an adhesion layer may be formed by being applied onto the surface of the sintered R1-T-B based magnet work 100, for example. Using an adhesion layer allows the diffusion source in powder state to easily adhere to a plurality of regions (e.g., the upper face 100*a* and the side face 100*b*) with different normal directions through a single application step, without having to change the orientation of the sintered R1-T-B based magnet work 100.

Examples of usable tackiness agents include PVA (polyvinyl alcohol), PVB (polyvinyl butyral), PVP (polyvinyl pyrrolidone), and the like. In the case where the tackiness agent is an aqueous tackiness agent, the sintered R1-T-B based magnet work may be subjected to preliminary heating before the application. The purpose of preliminary heating is to remove excess solvent and control tackiness, and to allow the tackiness agent to adhere uniformly. The heating temperature is preferably 60° C. to 100° C. In the case of an organic solvent-type tackiness agent that is highly volatile, this step may be omitted.

The method of applying a tackiness agent onto the surface of the sintered R1-T-B based magnet work may be arbitrary. Specific examples of application include spraying, immersion, application by using a dispenser, and so on.

In one preferable implementation, the tackiness agent is applied onto the entire surface of the sintered R1-T-B based magnet work. Rather than on the entire surface of the sintered R1-T-B based magnet work, the tackiness agent may be allowed to adhere onto a portion thereof. Especially in the case where the sintered R1-T-B based magnet work has a small thickness (e.g., about 2 mm), merely allowing the diffusion source in powder state to adhere to one surface that is the largest in geometric area among all surfaces of the sintered R1-T-B based magnet work may in some cases permit at least one of Dy and Tb to diffuse throughout the entire magnet, thereby being able to improve $H_{cJ}$.

As described earlier, the powder particles composing the diffusion source that is in contact with the surface of the sintered R1-T-B based magnet work 100 has a texture with good uniformity. In one embodiment, the entire surface of the alloy particles is oxidized, and therefore the powder particles are less likely to ignite through contact with the oxygen in the atmospheric air, and characteristic variations due to contact with the ambient of atmospheric air are reduced. Thus, performing the below-described heating for diffusion allows at least one of Dy and Tb contained in the diffusion source to efficiently diffuse from the surface of the sintered R1-T-B based magnet work into the interior, without wasting it.

The amount(s) of at least one of Dy and Tb contained in the diffusion source that is on the magnet surface may be set in the range from 0.5% to 3.0% by mass ratio with respect to the sintered R1-T-B based magnet work. For an even higher $H_{cJ}$, it may be set in the range from 0.7% to 2.0%.

Note that the amount(s) of at least one of Dy and Tb contained in the diffusion source depends not only on the concentrations of Dy and Tb in the powder particles, but also on the particle size of the powder particles composing the diffusion source. Therefore, while maintaining the concentrations of Dy and Tb constant, it is still possible to adjust the amounts of Dy and Tb to be diffused by adjusting the particle size of the powder particles composing the diffusion source.

[Heat Treatment]

The temperature of the heat treatment for diffusion is equal to or less than the sintering temperature of the sintered R1-T-B based magnet work (specifically, e.g. 1000° C. or lower). In the case where the diffusion source contains a powder of an RLM1M2 alloy or the like, the temperature is higher than the melting point of that alloy, e.g. 500° C. or above. The heat treatment time is 10 minutes to 72 hours, for example. After the heat treatment, as necessary, 10 minutes to 72 hours of further heat treatment may be conducted at 400° C. to 700° C.

Such a heat treatment allows at least one of Dy and Tb contained in the diffusion source to diffuse from the surface of the sintered R1-T-B based magnet work into the interior.

EXAMPLES

Experimental Example 1

First, by a known method, sintered R1-T-B based magnet works with the following mole fractions were produced: Nd=23.4, Pr=6.2, B=1.0, Al=0.4, Cu=0.1, Co=1.5, balance Fe (mass %). The dimensions of each sintered R1-T-B based magnet work were: thickness 5.0 mm×width 7.5 mm×length 35 mm.

Next, alloy powders of compositions as shown in Table 1 were produced by atomization. Each resultant alloy powder had a particle size of 106 μm or less (as confirmed through screening). Next, under the conditions (temperature and time) shown in Table 1, each alloy powder was subjected to a heat treatment (except for No. 1, which received no heat treatment), whereby diffusion sources (Nos. 1 to 20) were obtained from the alloy powders. Moreover, the ambient within the furnace during the heat treatment was adjusted so that the diffusion sources (Nos. 1 to 20) each had an oxygen content as approximately indicated in Table 1. The oxygen contents of the diffusion sources are shown in Table 1. The composition of each alloy powder in Table 1 was measured by using Inductively Coupled Plasma Optical Emission Spectroscopy (ICP-OES). Moreover, the oxygen content in each diffusion source was measured by using a gas analyzer based on gas fusion infrared absorption.

An average crystal grain size of an intermetallic compound phase in each resultant diffusion source was measured by the following method. First, a cross section of powder particles composing the diffusion source was observed with a scanning electron microscope (SEM), and separated into phases based on contrast, and the composition of each phase was analyzed by using energy dispersive X-ray spectroscopy (EDX), thereby identifying intermetallic compound phases. Next, by using image analysis software (Scandium), the intermetallic compound phase that had the highest area ratio was determined to be an intermetallic compound phase that was contained in the largest amount, and a crystal grain size of this intermetallic compound phase was determined. Specifically, the number of crystal grains in the intermetallic compound phase and the entire area of the crystal grains were determined by using image analysis software (Scandium), and the entire area of the crystal grains was divided by the number of crystal grains, thereby deriving an average area. Then, according to formula 1, a crystal grain size D was determined from the resultant average area.

$$D = \sqrt{\frac{4S}{\pi}} \quad \text{[formula 1]}$$

In the above, D is the crystal grain size, and S is the average area.

This set of processes was performed 5 times (i.e., powder particles were examined), and an average value thereof was derived, thus determining an average crystal grain size of the intermetallic compound phase of the diffusion source. The results are shown as average crystal grain sizes in Table 1. Note that in No. 1, where the diffusion source was not subjected to a heat treatment, the crystal grain size of the intermetallic compound phase was too small (crystal grains as small as 1 μm or less) to be measured.

Next, a tackiness agent was applied onto each sintered R1-T-B based magnet work. The method of application involved heating the sintered R1-T-B based magnet work to 60° C. on a hot plate, and thereafter applying a tackiness agent onto the entire surface of the sintered R1-T-B based magnet work by spraying. As the tackiness agent, PVP (polyvinyl pyrrolidone) was used.

Next, the diffusion sources of Nos. 1 to 20 in Table 1 were allowed to adhere to sintered R1-T-B based magnet works having the tackiness agent applied thereto. For each type of diffusion source (i.e., for each of Nos. 1 to 20), 50 sintered R1-T-B based magnet works. In the method of adhesion, the diffusion source (alloy powder) was spread in a vessel, and after a sintered R1-T-B based magnet work having the tackiness agent applied thereto was cooled to room temperature, the diffusion source was allowed to adhere to the entire surface of the sintered R1-T-B based magnet work in the vessel, as if to dust the sintered R1-T-B based magnet work with the diffusion source.

Next, a diffusing step was performed, in which each sintered R1-T-B based magnet work with the diffusion source was placed in a process chamber, and were heated at 900° C. (which was not higher than the sintering temperature) for 8 hours, thereby allowing at least one of Dy and Tb contained in the diffusion source to diffuse from the surface into the interior of the sintered R1-T-B based magnet work. From a central portion of each sintered R-T-B based magnet after diffusion, a cube having thickness 4.5 mm×width 7.0 mm×length 7.0 mm was cut out, and for 10 pieces of each type of diffusion source (i.e., for each of Nos. 1 to 20), coercivity was measured with a B—H tracer, and a value obtained by subtracting the minimum value of coercivity from the maximum value of coercivity thus determined was defined as a magnetic characteristic variation ($\Delta H_{cJ}$). The values of $\Delta H_{cJ}$ are shown in Table 1.

TABLE 1

| | composition of alloy powder (mass %) | | | | | | | | melting point | heat treatment | | average crystal grain size | oxygen content | ΔHcJ | |
|---|---|---|---|---|---|---|---|---|---|---|---|---|---|---|---|
| | | | | | | | | | | temperature | time | | | | |
| No. | Nd | Pr | Tb | Dy | Cu | Al | Ga | Co | ° C. | ° C. | Hr | μm | mass % | kA/m | Notes |
| 1 | 43 | 0 | 42 | 0 | 15 | 0 | 0 | 0 | 660 | None | — | — | 0.09 | 60 | Comp. |
| 2 | 43 | 0 | 42 | 0 | 15 | 0 | 0 | 0 | 660 | 560 | 2 | 4.3 | 0.2 | 20 | Inv. |
| 3 | 43 | 0 | 42 | 0 | 15 | 0 | 0 | 0 | 660 | 500 | 2 | 4.0 | 0.17 | 20 | Inv. |
| 4 | 43 | 0 | 42 | 0 | 15 | 0 | 0 | 0 | 660 | 460 | 2 | 3.5 | 0.15 | 21 | Inv. |
| 5 | 43 | 0 | 42 | 0 | 15 | 0 | 0 | 0 | 660 | 410 | 2 | 3.2 | 0.12 | 25 | Inv. |
| 6 | 43 | 0 | 42 | 0 | 15 | 0 | 0 | 0 | 660 | 300 | 2 | 2.1 | 0.1 | 55 | Comp. |
| 7 | 43 | 0 | 42 | 0 | 15 | 0 | 0 | 0 | 660 | 500 | 2 | 4.0 | 0.53 | 18 | Inv. |
| 8 | 43 | 0 | 42 | 0 | 15 | 0 | 0 | 0 | 660 | 500 | 2 | 4.0 | 1.23 | 16 | Inv. |
| 9 | 43 | 0 | 42 | 0 | 15 | 0 | 0 | 0 | 660 | 500 | 2 | 4.0 | 2.5 | 15 | Inv. |
| 10 | 43 | 0 | 42 | 0 | 15 | 0 | 0 | 0 | 660 | 500 | 2 | 4.0 | 4.0 | 15 | Inv. |
| 11 | 43 | 0 | 42 | 0 | 15 | 0 | 0 | 0 | 660 | 500 | 2 | 4.0 | 4.5 | 22 | Inv. |
| 12 | 65 | 0 | 20 | 0 | 15 | 0 | 0 | 0 | 560 | 400 | 2 | 3.9 | 0.2 | 22 | Inv. |
| 13 | 75 | 0 | 10 | 0 | 15 | 0 | 0 | 0 | 520 | 400 | 2 | 4.1 | 0.22 | 21 | Inv. |
| 14 | 43 | 0 | 0 | 42 | 15 | 0 | 0 | 0 | 690 | 500 | 2 | 3.8 | 0.17 | 20 | Inv. |
| 15 | 48 | 0 | 42 | 0 | 10 | 0 | 0 | 0 | 680 | 500 | 2 | 3.7 | 0.3 | 20 | Inv. |
| 16 | 48 | 0 | 29 | 0 | 23 | 0 | 0 | 0 | 700 | 500 | 2 | 3.5 | 0.24 | 24 | Inv. |
| 17 | 0 | 0 | 85 | 0 | 15 | 0 | 0 | 0 | 780 | 600 | 2 | 3.7 | 0.18 | 23 | Inv. |
| 18 | 40 | 10 | 35 | 0 | 12 | 3 | 0 | 0 | 670 | 460 | 2 | 3.4 | 0.16 | 21 | Inv. |
| 19 | 43 | 0 | 12 | 30 | 10 | 0 | 5 | 0 | 690 | 460 | 2 | 3.3 | 0.15 | 22 | Inv. |
| 20 | 60 | 0 | 25 | 0 | 14 | 0 | 0 | 1 | 640 | 460 | 2 | 3.7 | 0.15 | 21 | Inv. |

Inv.: Example of the Invention
Comp.: Comparative Example

Table 1 indicates that, relative to No. 1 (Comparative Example) in which no heat treatment was performed for the alloy powder and No. 6 (Comparative Example) in which the heat treatment temperature was outside the range defined by the present disclosure, Examples of the present invention (Nos. 2 to 5, Nos. 7 to 20) all had a $\Delta H_{cJ}$ value which was not more than a half thereof, i.e., variations in the magnetic characteristics in the diffusing step were suppressed. Among others, Nos. 7 to 10, in which the oxygen content in the diffusion source was not less than 0.5 mass % and not more than 4.0 mass %, had $\Delta H_{cJ}$ values of 18 kA/m or less, indicating that variations in the magnetic characteristics in the diffusing step were further suppressed.

Embodiments of the present disclosure are able to improve $H_{cJ}$ of the sintered R-T-B based magnet with less Dy and/or Tb, and therefore are applicable to the production of a rare-earth sintered magnet where high coercivity is desired. Moreover, the present disclosure is also applicable to allowing a metallic element other than a heavy rare-earth element RH to diffuse into a rare-earth sintered magnet from its surface.

What is claimed is:

1. A method for producing a sintered R-T-B based magnet, comprising:

providing a sintered R1-T-B based magnet work, where R1 is a rare-earth element; T is Fe, or Fe and Co;

providing a powder of an alloy in which a rare-earth element R2 accounts for 40 mass % or more of the entire alloy, the rare-earth element R2 always including at least one of Dy and Tb;

subjecting the alloy powder to a heat treatment at a temperature which is not lower than a temperature that is 250° C. below a melting point of the alloy powder and which is not higher than the melting point, to obtain a diffusion source from the alloy powder; and placing the sintered R1-T-B based magnet work and the diffusion source in a process chamber, and heating the sintered R1-T-B based magnet work and the diffusion source to a temperature which is not higher than a sintering temperature of the sintered R1-T-B based magnet work, to allow the at least one of Dy and Tb contained in the diffusion source to diffuse from the surface into an interior of the sintered R1-T-B based magnet work, wherein the alloy powder is a powder produced by atomization and is composed of particles of an intermetallic compound having an average crystal grain size exceeding 3 μm.

2. The method for producing a sintered R-T-B based magnet of claim 1, wherein an oxygen content in the diffusion source is not less than 0.5 mass % and not more than 4.0 mass %.

3. The method for producing a sintered R-T-B based magnet of claim 1, wherein the alloy is an RHRLM1M2 alloy, where RH is one or more selected from the group consisting of Sc, Y, Gd, Tb, Dy, Ho, Er, Tm, Yb and Lu, always including at least one of Tb and Dy; RL is one selected from the group consisting of La, Ce, Pr, Nd, Pm, Sm and Eu, always including at least one of Pr and Nd; and each of M1 and M2 is one or more selected from the group consisting of Cu, Fe, Ga, Co, Ni and Al, where possibly M1=M2.

4. The method for producing a sintered R-T-B based magnet of claim 1, wherein the alloy is an RHM1M2 alloy, where RH is one or more selected from the group consisting of Sc, Y, Gd, Tb, Dy, Ho, Er, Tm, Yb and Lu, always including at least one of Tb and Dy; and each of M1 and M2 is one or more selected from the group consisting of Cu, Fe, Ga, Co, Ni and Al, where possibly M1=M2.

* * * * *